US005577732A

United States Patent [19]

Spector

[11] Patent Number: 5,577,732

[45] Date of Patent: Nov. 26, 1996

[54] TOY MISSILE

[76] Inventor: Donald Spector, 380 Mountain Rd., Union City, N.J. 07087

[21] Appl. No.: 596,652

[22] Filed: Feb. 5, 1996

[51] Int. Cl.[6] ..... A63B 65/00

[52] U.S. Cl. ..... 273/317; 273/58 H; 273/58 K; 273/428

[58] Field of Search ..... 273/317, 428, 273/58 H, 58 K

[56] References Cited

U.S. PATENT DOCUMENTS

| | | | |
|---|---|---|---|
| 2,960,794 | 11/1960 | Johns | 273/58 K X |
| 4,294,447 | 10/1981 | Clark | 273/428 X |
| 4,834,382 | 5/1989 | Spector | 273/65 EC |
| 4,917,381 | 4/1990 | Spector | 273/58 H |
| 5,070,610 | 12/1991 | Leslie | 273/58 H X |
| 5,251,908 | 10/1993 | Myers | 273/58 K X |
| 5,288,261 | 2/1994 | Spector | 273/58 H X |
| 5,290,041 | 3/1994 | Kettelson | 273/428 X |

*Primary Examiner*—William H. Grieb
*Attorney, Agent, or Firm*—Michael Ebert

[57] ABSTRACT

A toy missile having a hollow head created by a collapsible plastic film casing and a balloon inflated therein, causing the head to assume a globular form. Projecting from the casing are shaped pieces which impart a figurative or fanciful form to the head. Extending from the rear pole of the globular head and held thereto by a tail is a streamer. When a player grasps the streamer and then whirls the missile and lets it fly, the streamer then acts as a tail fin to stabilize the flight pattern. Deposited in the balloon is a liquid charge which due to centrifugal forces generated by the whirling action causes the liquid to form a concentrated mass at the leading pole of the head which acts to lengthen the flight path of the missile.

8 Claims, 1 Drawing Sheet

TOY MISSILE

BACKGROUND OF INVENTION

1. Field of Invention

This invention relates generally to toy missiles which are launched by whirling the missile and then releasing it to let the missile fly, and more particularly to a toy missile formed by an inflated globular head from whose rear pole extends a streamer held thereto by a tail.

2. Status of Prior Art

The typical inflatable beach ball of the type in use at outdoor swimming pools and beaches is made from polyvinyl film material, the ball being provided with a valved air inlet so that it can be inflated by mouth. Such thin-skinned beach balls are relatively very light in relation to their surface area. As a consequence, the typical light-weight beach ball offers a much greater surface area to air than smaller balls, and little resistance to wind deflection, so that the ball cannot be thrown very far. And on a windy day, it is almost impossible to play with a beach ball.

My prior U.S. Pat. No. (Spector) 4,834,352, discloses a pneumatic play ball having an outer casing formed of non-stretchable material which when fully expanded assumes a ball configuration. Within the casing is an inflatable balloon whose neck initially projects through a small port in the casing. When the balloon is inflated, it expands to engage and conform to the inner surface of the casing, after which the neck is tied and pushed within the port whereby the balloon is then fully encased. While a ball of the type disclosed in my prior '352 patent has distinct advantages over conventional beach balls, it is still lacking in weight and subject to wind deflection.

To overcome this drawback, my prior U.S. Pat. No. (Spector) 4,917,381 discloses a variable weight play ball in which weight is imparted therto by a layer of water which is uniformly and symmetrically distributed throughout the ball regardless of the thickness of the layer, whereby the play characteristics of the ball are comparable to those of conventional heavy balls of high quality.

My prior U.S. Pat. No. (Spector) 5,288,261 discloses a figurative toy missile in animal-like or humanoid form defined by a head and a torso having appendages extending therefrom. The missile structure is such that when the missile is thrown by a player, it will spin, or execute other excursions in flight, depending on how the appendages are grasped by the player. The torso is formed by an outer fabric casing enclosing a rubber balloon inflated with water, whereby the torso functions a weighted ball.

The concern of the present invention is with a toy missile having a hollow globular head created by a balloon inflated within a collapsible casing.

SUMMARY OF INVENTION

In view of the foregoing the main object of this invention provide a toy missile having a hollow globular head from whose rear pole extends a streamer, whereby when the streamer is grasped by a player and the missile is whirled and then released to let it fly, it flies in a flight path determined by the point in space in which the missile is released.

Among the significant advantages of a toy missile in accordance with the invention are the following:

A. the missile operates in the manner of a sling and therefore can be directed toward a target;

B. yet the missile is innocuous, for its globular warhead is formed by a collapsible plastic film casing within which is an inflated rubber balloon; hence when it strikes a target it bounces off;

C. the missile, when not in use, may be collapsed into a compact, easily packaged form.

More particularly, an object of the invention is to provide a missile of the above type in which the collapsible casing which forms the head has soft, shaped pieces projecting therefrom to impart a figurative or fanciful form to the head. Thus if the resultant form is that of a duck, the missile in flight suggests a flying duck.

Yet another object of the invention is to provide a toy missile of the above type whose streamer extending from the rear pole of the globular head functions as a tail fin to stabilize the flight pattern.

Still another object of the invention is to provide a toy missile of the above type in which a liquid charge deposited in an inflated balloon confined within the casing forming its head acts to lengthen the flight path of the missile so that when let fly it will travel a relatively long distance.

Briefly stated, these objects are attained by a toy missile having a hollow head created by a collapsible plastic film casing and a balloon inflated therein, causing the head to assume a globular form. Projecting from the casing are shaped pieces which impart figurative of fanciful form to the head. Extending from the rear pole of the globular head and held thereto by a tail is a streamer. When a player grasps the streamer and then whirls the missile and lets it fly, the streamer then acts as a tail fin to stabilize the flight pattern.

Deposited in the balloon is a liquid charge which due to centrifugal forces generated by the whirling action causes the liquid to form a concentrated mass at the leading pole of the head which acts to lengthen the flight path of the missile.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
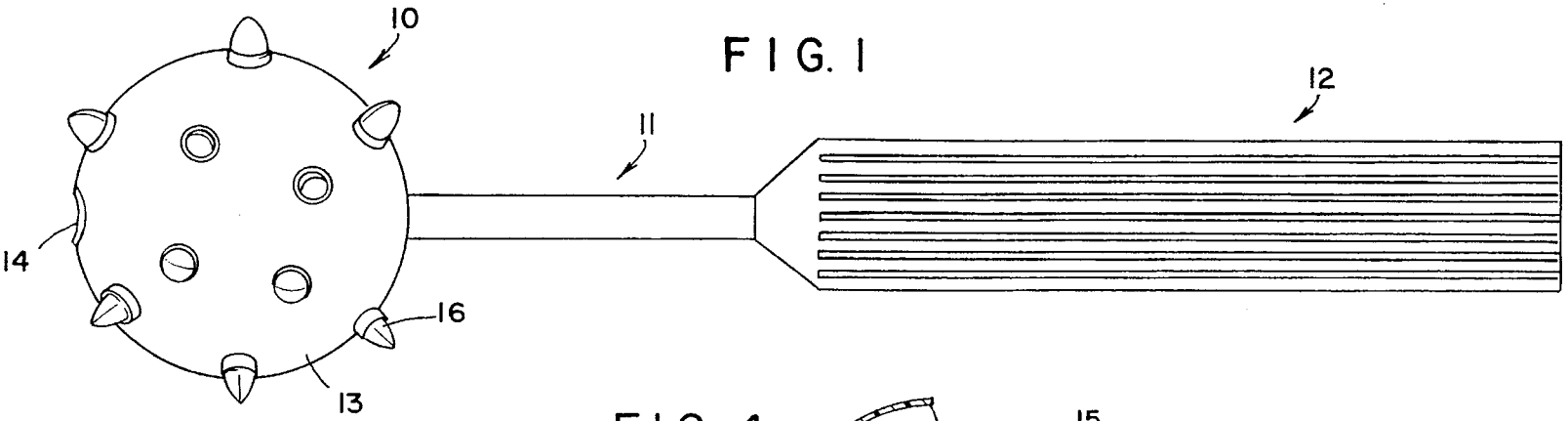
FIG. 1 is a prospective view of one embodiment of a toy missile in accordance with the invention.
Figure 2:
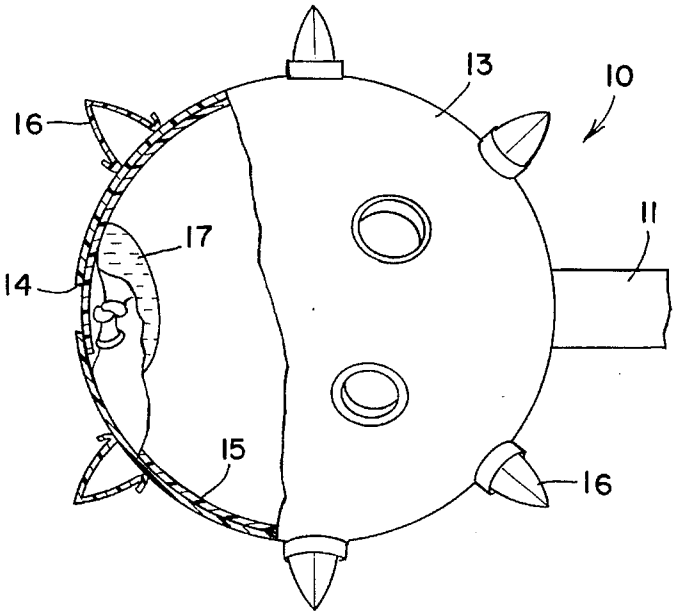
FIG. 2 is a section taken through the inflated hollow head of the missile when it is in flight.

First Embodiment:

Referring now to FIGS. 1 and 2, there is shown a toy missile in accordance with the invention whose principal components are a hollow globular head 10 having a tail 11 extending from its rear pole joined to a relatively broad, elongated rectangular streamer 12.

Figure 4:
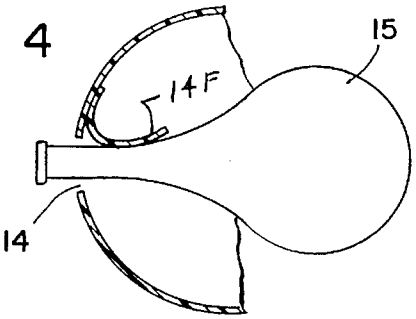
FIG. 4 shows an uninflated balloon within the casing, the neck of the balloon then projecting out of the inlet port so that the balloon can be inflated.
Figure 3:
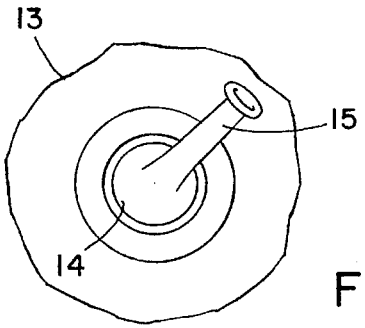
FIG. 3 separately illustrates the inlet port in the casing through which is inserted an uninflated balloon.

Head 10 includes a collapsible spherical casing 13 formed of flexible non-stretchable synthetic plastic film material having a thickness no greater than about three or four mils, such as PVC, polyethylene or other high strength plastic film material. The leading pole of casing 13 is provided with a circular inlet port 14. As shown separately in FIG. 4, port 14 has attached thereto a flap 14F which when pushed into the port, then shutters the port. Inserted through open inlet port 14 is a rubber balloon 15 in its uninflated state, as shown in FIG. 3, the neck of the balloon then projecting from the inlet port so that the balloon can be mouth inflated.

Initially, both balloon 15 and casing 13 are collapsed, hence the missile in this state can be put into a compact state for packaging and shipment. When the missile is to be put to use, the balloon is inserted in the casing and then inflated so that it is confined within and tightly conforms to the inner surface of the casing which then assumes its normally spherical form to create a globular head.

The balloon is inflated to an air pressure well above atmospheric pressure, so that the globular head is then very bouncy and when it strikes a target it will bounce off the target, and inflict no damages thereto. Thus if the head of the missile strikes a child, it will cause no injury.

While a rubber balloon is relatively fragile and easily burst, because in the missile the balloon is encased in a non-stretchable, flexible plastic film casing, the balloon is then virtually indestructable, and should the head of the missile strike a hard surface with a high impact force, the globular head will bounce off this surface and retain its integrity.

In practice, after the balloon is inflated through its neck which projects from the open inlet port 14, the neck is then tied to hermetically seal the inflated balloon. The tied neck is then pushed into the port below the casing, and the flap 14F is then closed so that the balloon cannot extrude through the port and the balloon is fully confined within the casing.

Tail 11 joined to the trailing pole of globular head, 10 is formed by a narrow strip of double-ply flexible plastic film material which may be the same as the film material forming the casing of the globular head 10. The tail is thermally bonded or otherwise attached to the rear pole of the spherical casing which is formed of thermoplastic film material.

Streamer 12 joined to the end of tail 11 is formed of the same or similar synthetic plastic flexible film material, and is relatively broad. Streamer 12 serves a dual function. Its first function is to make it possible to launch the missile. By grasping the streamer, one is then able to whirl the toy missile in a wide orbit in the manner of a sling used to throw stones and other misslies by whirling it around and releasing it to let it fly with a centrifugal force in a direction determined by the point in space at which the missile is let loose.

The second function of the rectangular streamer is that in flight it serves as a tail fin to stabilize the flight pattern and cause the missile to travel in the direction in which it is launched.

Thermally sealed or otherwise attached to the outer surface of the plastic film casing 13 at uniformly distributed positions therein are soft flexible plastic pieces 16 formed by a base collar on which is anchored a peaked dome to simulate a spike. These spikes convert globular head 10 into the head of a classic mace.

A mace is a medieval weapon in the form of a war club having a spiked metal head which when the club is swung by a warrior, is capable of crushing a knight's armor. In the context of the toy missile shown in FIG. 1, the toy missile is, in effect, a flying mace having soft spikes and therefore innocuous, the streamer being effectively the club of the mace.

Hollow globular head 10 of the missile is relatively light; hence even when the missile is vigorously whirled and then released to let it fly, it will not travel a long distance. In order therefore to exploit the centrifugal forces produced when whirling the toy missile, deposited in the balloon 15 before it is inflated, is a charge of water or other liquid such as glycerin, which when the missile is whirled, the resultant centrifugal forces cause the charge of liquid to form a liquid mass 17 concentrated at the leading pole of the globular head, as shown in FIG. 2.

Since acceleration of the released missile is a function of the mass of the head and the force applied thereto, the flying missile will travel a much greater distance than it would in the absense of the liquid mass. And since the mass is concentrated at the leading pole of the globular head, the missile will travel along a path aligned with the polar axis.

Figure 5:
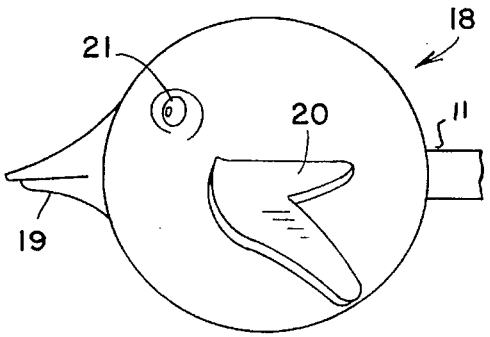
FIG. 5 is a perspective view of the figurative head of another embodiment of the missile.

Second Embodiment:

In this embodiment of the toy missile, only the globular head is illustrated in FIG. 5, for in all other respects the second embodiment is identical to the first embodiment illustrated in FIG. 1, and includes a streamer 12 extending from the rear pole of the head and joined thereto by a tail 11.

In the second embodiment, the globular head 18 which is formed by a collapsible casing and an inflated balloon confined therein, the head in this instance is provided with soft pieces attached to the surface of the head casing to simulate a figurative form, which in the example shown is that of the head of a duck.

Hence attached to head 18 at its leading pole is a soft piece 19 to simulate the beak of a duck, and attached to opposing sides of the globular head are soft pieces 20 to simulate the wings of the duck. The surface of the casing is color printed to create eyes 21 and other details appropriate to a duck's head. The head design may be such as to create any figurative of fanciful form, such as that of a dragon, and the tail and streamer may also be decoratively printed to create graphics appropriate to the head. Thus if the head is that of a dragon, the tail and streamer may have graphics simulating the elongated horny tail of a dragon.

While there has been shown and described preferred embodiments of a toy missile, it will be appreciated that many changes and modifications may be made therein without, however, departing from the essential spirit thereof.

I claim:

1. A toy missile comprising:

A. a globular head formed by a collapsible spherical casing of flexible material and a balloon inflated within the casing and conforming thereto to maintain the head in a spherical form, said head having a leading pole and a trailing pole;

B. an elongated, generally rectangular flat streamer of flexible material joined to the trailing pole of the head and extending therefrom, whereby when the streamer is grasped by a player to whirl the missile and then release it to let it fly, the streamer then acts as a tail fin to stabilize the flight; and C. a charge of liquid deposited in the balloon which when the missile is whirled the resultant centrifugal force causes the liquid to form a concentrated mass adjacent the leading pole of the head to lengthen the flight path of the missile.

2. A toy missile as set forth in claim 1, in which the streamer is joined to the rear pole by a relatively narrow tail.

3. A toy missile as set forth in claim 1, in which said casing is formed of synthetic plastic film material.

4. A toy missile as set forth in claim 1, in which the streamer is formed of synthetic plastic film material.

5. A missile as set forth in claim 1, in which an inlet port is formed at the leading pole of the casing to admit said balloon in an uninflated state therein.

6. A missile as set forth in claim 5, in which said port is provided with a flap to shutter the port after the balloon is inflated and a neck of the balloon projecting through the port is tied to seal the balloon, the tied neck then being pushed into the port under the casing.

7. A missile as set forth in claim 1, in which the head has soft, spike-shaped pieces attached to the surface of the casing to simulate the head of a mace.

8. A missile as set forth in claim 1, in which the head has soft pieces attached to the surface of the casing to simulate an animal-like, fanciful figure.

* * * * *